United States Patent [19]

Laufer

[11] Patent Number: 4,530,337

[45] Date of Patent: Jul. 23, 1985

[54] FUEL INJECTION PUMP

[75] Inventor: Helmut Laufer, Stuttgart, Fed. Rep. of Germany

[73] Assignee: Robert Bosch GmbH, Stuttgart, Fed. Rep. of Germany

[21] Appl. No.: 556,816

[22] Filed: Dec. 1, 1983

[30] Foreign Application Priority Data

Jan. 13, 1983 [DE] Fed. Rep. of Germany ..... 3300876

[51] Int. Cl.[3] ..... F02M 37/04

[52] U.S. Cl. ..... 123/506; 123/459; 123/300

[58] Field of Search ..... 123/506, 459, 458, 449, 123/503, 299, 300

[56] References Cited

U.S. PATENT DOCUMENTS

| | | | |
|---|---|---|---|
| 2,918,048 | 12/1959 | Aldinger et al. | 123/459 |
| 3,699,939 | 10/1972 | Eckert et al. | 123/506 |
| 4,348,998 | 9/1982 | Stumpp | 123/506 |
| 4,395,987 | 8/1983 | Kobayashi et al. | 123/506 |
| 4,445,484 | 5/1984 | Marion | 123/506 |
| 4,458,648 | 7/1984 | Braun et al. | 123/506 |

FOREIGN PATENT DOCUMENTS

| | | | |
|---|---|---|---|
| 1576617 | 7/1970 | Fed. Rep. of Germany | |
| 2079861 | 1/1982 | United Kingdom | 123/506 |

*Primary Examiner*—Magdalen Y. C. Moy
*Attorney, Agent, or Firm*—Edwin E. Greigg

[57] ABSTRACT

A fuel injection pump in which a pump work chamber can be connected with a fuel withdrawal chamber, which is controlled by a deflecting piston. The deflecting piston is loaded by the pressure of the pump work chamber and is adjustable counter to a restoring force, this restoring force being modified with pressure fluid in accordance with rpm.

20 Claims, 7 Drawing Figures

FUEL INJECTION PUMP

BACKGROUND OF THE INVENTION

The invention is based on a fuel injection pump. In a fuel injection pump of this kind known from German Auslegeschrift No. 1 576 617, a deflecting piston is provided which defines a fuel withdrawal chamber connected via a throttle with the pump work chamber. The deflecting piston is restored by a compression spring supported on a spring plate embodied in the manner of a piston. Coaxially with the compression spring, a stop tang protrudes inward from the spring plate, blocking the deflecting piston after a certain amount of compression has taken place on the part of the restoring spring. The piston-like spring plate is pressed by the compression spring against a stop within a cylinder bore and from the opposite side is acted upon by a pressure medium at a rpm-dependent pressure. If this pressure exceeds the tension of the restoring spring, then the piston-like spring plate is displaced far enough that the deflecting piston is blocked. This apparatus for displacing the piston-like spring plate serves to switch off the movement of the deflecting piston in an rpm-dependent manner. With the aid of the deflecting piston and of the withdrawal chamber connected via the throttle with the pump work chamber, the course of the injection rate per crankshaft angle during one injection which is attained by the known apparatus is in steps or stages. After the blocking of the deflecting piston, the otherwise usual course of injection is supposed to be adhered to. In a different embodiment, beyond a predetermined stroke distance an additional valve opens up and additional connection at the deflecting piston for communication with the pump work chamber. The result in the known apparatus is that the injection pressure is so severely reduced that the injection valve closes in the meantime, preventing further fuel from being injected. With an apparatus of this kind, a pre-injection which is separate from the main injection is attained. Beyond a predetermined rpm, the deflecting piston is again blocked, so that fuel then continues to be injected in the usual manner.

Such devices serve to make the course of combustion smoother, and particularly in self-igniting engines with fuel injection directly into the combustion chamber they serve to prevent too much fuel from collecting in the combustion chamber from the time that the first injection begins until the ignition delay period has elapsed; such excess fuel then combusts abruptly. This abrupt combustion causes a steep increase in pressure and is accordingly associated with considerable noise during combustion.

Aside from the above known apparatus, other injection nozzles with which a pre-injection can be realized are also known. Such nozzles are associated with considerable expense, however, as compared with a disposition of the type initially discussed above.

The apparatus of the type initially discussed above is also relatively expensive in terms of its embodiment, in which a pre-injection which is offset from the main injection in terms of time is supposed to be attained, and in its operation it is highly dependent on the rpm. With increasing rpm, the throttle connection between the withdrawal chamber and the pump work chamber has an increasingly pronounced effect, as do all the other controlled connections. The pre-injection thereby attainable thus varies widely in response to dynamic operating conditions. Although this influence is rendered ineffective in the known apparatus by blocking the deflecting piston beyond a certain rpm, still the known apparatus accordingly has the disadvantage that it is effective over only a small portion of the entire operating range.

OBJECT AND SUMMARY OF THE INVENTION

The fuel injection pump according to the invention has the advantage that it is effective over the entire operating range of the fuel injection pump or of the associated internal combustion engine, with the injection quantities being subdivided. As a result of the rpm-dependent influence exerted on the pressure of the pressure medium, the dynamic influences such as the inertial behavior of the deflecting piston of the rpm-dependent throttling effects of line connections can be advantageously compensated for.

Particularly with one embodiment set forth, the optimal pre-injection quantity for the engine at a given time can be adhered to in all operating ranges, because the quantity ascertained as optimal is regulated by means of a feedback of the nozzle needle movement and thus of the actual pre-injection quantity.

A further advantage is attained with which it is assured that any residual pressure in the withdrawal chamber will not affect the opening point of the connection between the pump work chamber and the withdrawal chamber at different rpm levels.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
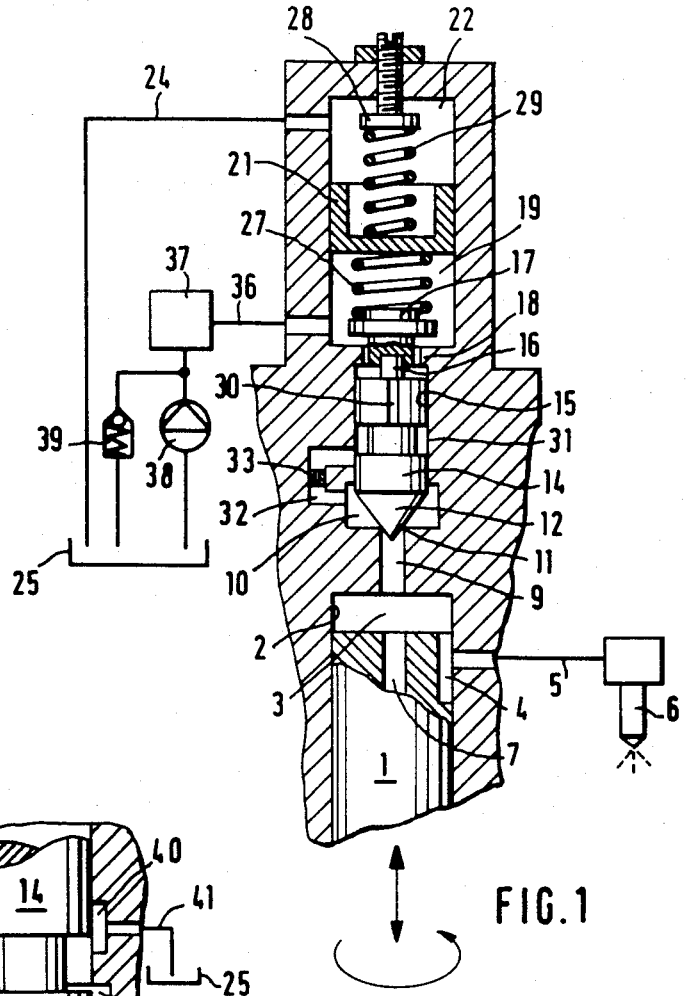
FIG. 1 shows a first exemplary embodiment, with a partial section through a part of a fuel injection pump.

FIG. 1 shows a portion of a fuel injection pump partly in a schematic section. A pump piston 1 is shown which encloses a pump work chamber 3 within a cylinder 2 to which fuel is admitted and in which the piston is set by means not shown in detail into a reciprocating, pumping and simultaneously rotating motion as well known in the art. In a known manner, the pump piston of this distributor injection pump acts during the rotation as a distributor; via a distributor groove 4 in the jacket face of the pump piston, fuel is pumped out of the pump work chamber into one of the fuel injection lines 5. These injection lines are distributed about the cylinder 2 in accordance with the number of cylinders of the associated internal combustion engine which are to be supplied with fuel. Via a relief line 7 branching off from the pump work chamber 3 and extending axially within the pump piston 1, the pump work chamber 3 can be made to communicate with a withdrawal chamber for the purpose of terminating the injection. The fuel positively displaced by the pump piston during a further pumping stroke is then delivered via the relief line 7 to the pump suction chamber, for instance, from which the pump work chamber 3 is supplied with fuel.

Also leading from the pump work chamber 3 is a passage 9 leading to a fuel withdrawal chamber 10. The mouth of the passage 9 toward the fuel withdrawal chamber 10 is embodied as a valve seat 11, on which a conical end face 12 of a deflecting piston 14 comes to rest. The conical end face 12 serves as the valve closing member and controls the connection beteen the pump work chamber 3 and the fuel withdrawal chamber 10. The deflecting piston 14 serves as a movable wall of the fuel withdrawal chamber 10.

The deflecting piston 14 is tightly displaceable within a bore 15 and on its rear end has a tang 16 on which a spring plate 17 is seated. The longitudinal displacement of the deflecting piston 14 is limited by a stop 18 formed by a shoulder located at the end of the bore 15, at a location where the bore 15 is congruent with a circular-cylindrical restoring chamber 19, the diameter of which is larger than the diameter of the bore 15. Acting as the second movable wall, an intermediate piston 21 is tightly displaceable within this restoring chamber 19. The intermediate piston 21 divides the restoring chamber 19 from a pressure chamber 22, which in the exemplary embodiment shown here is unpressurized and to this end communicates via a leakage line 24 with the fuel supply container 25, for example, of the fuel injection pump. A restoring spring in the form of a compression spring 27 is fastened between the intermediate piston 21 and the spring plate 17, and this spring 27 tends to keep the conical end face 12 of piston 14 against the valve seat 11. An additional spring 29, which in the present example is a compression spring, is also fastened in the pressure chamber 22 between the intermediate piston 21 and an adjustable stop 28 which is adjustable from the outside.

The deflecting piston 14 further has an annular groove 31 in the vicinity of its guidance in the bore 15; this annular groove 31 communicates continuously with the restoring chamber 19 via a longitudinal groove 30 in the surface of the deflecting piston 14 adjoining the spring plate 17. Branching off from the withdrawal chamber 10 is a relief line 32, which contains a throttle 33 and discharge into the cylinder 15 in such a way that, in the outset position of the deflecting piston 14, the mouth is just barely in communication with the annular groove 31. If the deflecting piston 14 rises from the valve seat 11, then the mouth is closed instantly by the portion of the deflecting piston 14 adjoining the annular groove 31. In the area of overlap, the throttle prevents fuel from flowing out in any significant quantity from the pump work chamber 3 to the restoring chamber 19.

Instead of the throttle 33 disposed in the relief line 32, the throttle can also be embodied directly by the overlap of the annular groove 31 with the entrance opening of the relief line 32 at the outset position of the deflecting piston 14. A further variant is shown by the embodiment in FIG. 2, where the separate relief line 32 is dispensed with entirely; instead, the annular groove 31 is placed at such a depth that in the outset position of the deflecting piston 14, a throttled connection 34 is established between the annular groove 31 and the withdrawal chamber 10. From this embodiment, it is also clear that the conical angle $\alpha_1$ of the conical end face 12 is smaller than the conical angle $\alpha_2$ of the valve seat 11. The purpose of this is that in the closing position of the deflecting piston 14, the same pressure area, determined by the cross section of the line 9, will always be effective during the pumping stroke of the pump piston.

In a further detail of the embodiment, the restoring chamber 19 is connected via a pressure medium supply line 36 with a source of pressure medium, which may for instance be the suction chamber 37 of the distributor injection pump. This suction chamber or source of pressure medium is supplied by a fuel feed pump 38, which is driven in synchronism with the fuel injection pump and aspirates fuel from a fuel supply container 25. The pressure building up on the pumping side of the fuel feed pump 38 is controlled in accordance with rpm by a pressure control valve 39 which returns the overpressure fuel back to the fuel supply container.

During operation, the apparatus described functions as follows:

During the pumping stroke of the pump piston 1, the pressure in the work chamber 3 is increased to such an extent that the valve needle of the injection valve 6 is raised in a known manner by fuel pressure, counter to the valve spring, and fuel proceeds to injection. The deflecting piston 14 is also stressed by the pressure buildup in the pump work chamber 3, as well as being acted upon by the restoring forces of the restoring spring 27 and the additional spring 29. With the increase in pressure in the pump work chamber, the deflecting piston 14 is also deflected, so that a portion of the fuel quantity pumped by the pump piston is withdrawn, and the pressure in the pump work chamber or on the pressure side of the injection valve 6 drops. The pressure is then below the opening pressure of the nozzle needle in the injection valve 6, and the nozzle needle closes. The result is an interruption of the injection until such time as the further pumping movement of the pump piston 1 has reestablished a sufficient fuel pressure in the pump work chamber 3 or in the injection line 5, causing the nozzle needle to open once again. The remaining fuel to be pumped is then injected, until as a result of the opening of the relief line 7 the pressure on the high-pressure side of the pump piston again collapses in the work chamber 3, and the injection is thereby terminated.

At this instant, the deflecting piston 14 also returns back to its place on the valve seat 11. In this position, the withdrawal chamber 10 is then relieved in favor of the restoring chamber 19, via the relief line 32, the throttle 33, the annular groove 31 and the groove 30. This embodiment assures that before each new pumping stroke of the pump piston 1, the pressure in the fuel withdrawal chamber 10 is balanced, so that no resultant forces acting in the opening direction on the conical end face 12 inside the withdrawal chamber 10 can arise. To prevent fuel from flowing out of the pump work chamber 3 via the relief line 32 after the beginning of the pumping stroke of the pump piston 1, the relief line 32 is closed with the first movement on the part of the deflecting piston 14.

Figure 2:
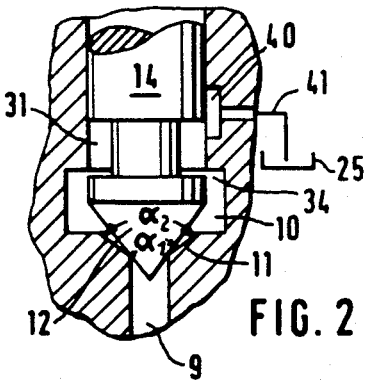
FIG. 2 shows a variant of the embodiment of the piston shown in FIG. 1 and acting as a movable wall.

The relief of the fuel withdrawal chamber 10 may also, as also shown in FIG. 2, be effected toward the fuel supply container 25 instead of toward the restoring chamber 19. In the jacket face of the bore 15, a longitudinal groove 40 is provided, which communicates continuously with the annular groove 31 and from which a leakage line 41 leads back to the fuel supply container 25.

Figure 3:
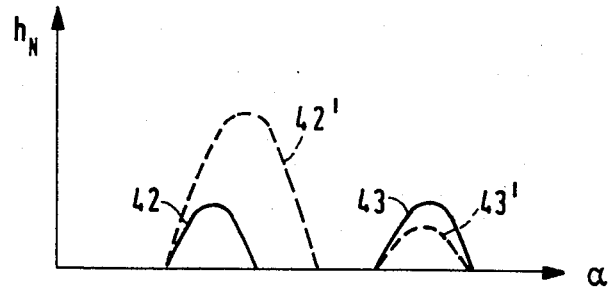
FIG. 3 PRIOR ART
FIG. 3 is a graph showing the course of injection at various rpm levels in an apparatus according to the prior art.
Figure 4:
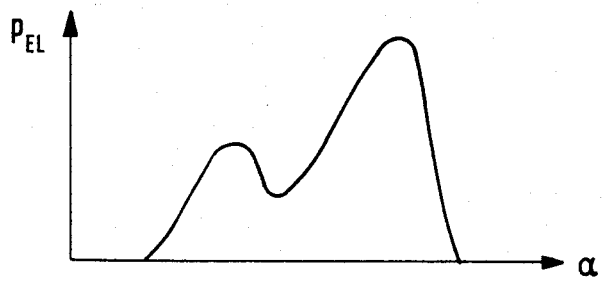
FIG. 4 is a graph showing the course of pressure in the pump work chamber in the embodiment of FIG. 1.

In FIG. 3, the solid lines indicate the injection behavior of the injection valve 6, the stroke of the nozzle needle being plotted over the angle of rotation of the pump piston, representing the crankshaft of the engine which is to be supplied with fuel by the fuel injection pump. The needle stroke shown simultaneously corresponds to the fuel injection quantity, which is injected by the injection valve into the combustion chambers of the engine. The solid line 42 shows the pre-injection, and the solid line 43 shows the main injection. An injection such as this would also result if the deflecting piston 14 were loaded only by a restoring spring 27 supported on a fixed stop and if the restoring chamber 19 were unpressurized. In an embodiment of that kind, however, with increasing rpm the resultant fuel distribution would be as shown by the dashed lines 42' and 43' of FIG. 1. Because of inertial behavior, the deflecting movement of the deflecting piston 14 is retarded with increasing rpm, so that the proportion of the pre-injection 42' becomes greater with increasing rpm, and the proportion of the main injection 43' decreases with increasing rpm. This is not desirable, however, and is avoided with the embodiment according to the invention. FIG. 4 shows the course of pressure in the pump work chamber or on the high-pressure side of the pump piston in an embodiment according to the invention. It is apparent that after an initial pressure increase, the pressure has dropped back below the opening pressure of the nozzle needle of the injection valve and then, after the termination of the deflecting movement of the deflecting piston 14, once again rises steeply overall to its final value until the termination of the injection.

Figure 5:
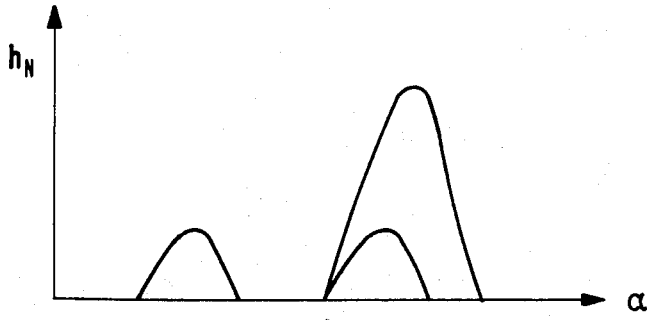
FIG. 5 is a graph showing the course of the needle stroke at various operational points.

In the embodiment according to the invention, an increasing pressure is built up in the restoring chamber 19 with increasing rpm on the part of the fuel injection pump, and this pressure acts on the intermediate piston 21. The intermediate piston 21 is displaced counter to the force of the additional spring 29 and at the same time the initial stress of the restoring spring 27 is reduced. The thereby reduced restoring force on the deflecting piston 14 makes it easier for the deflecting piston 14 to react more quickly to the increase in pressure in the pump wprk chamber, so that at relatively high rpm and loads, the desired small pre-injection quantity can be attained, as is shown in FIG. 5. A constant pre-injection quantity and a main injection quantity that increases with load are preferably attained. With the adjustable stop, the initial stress of the restoring spring 27 and that of the additional spring 29 can be influenced.

Figure 6:
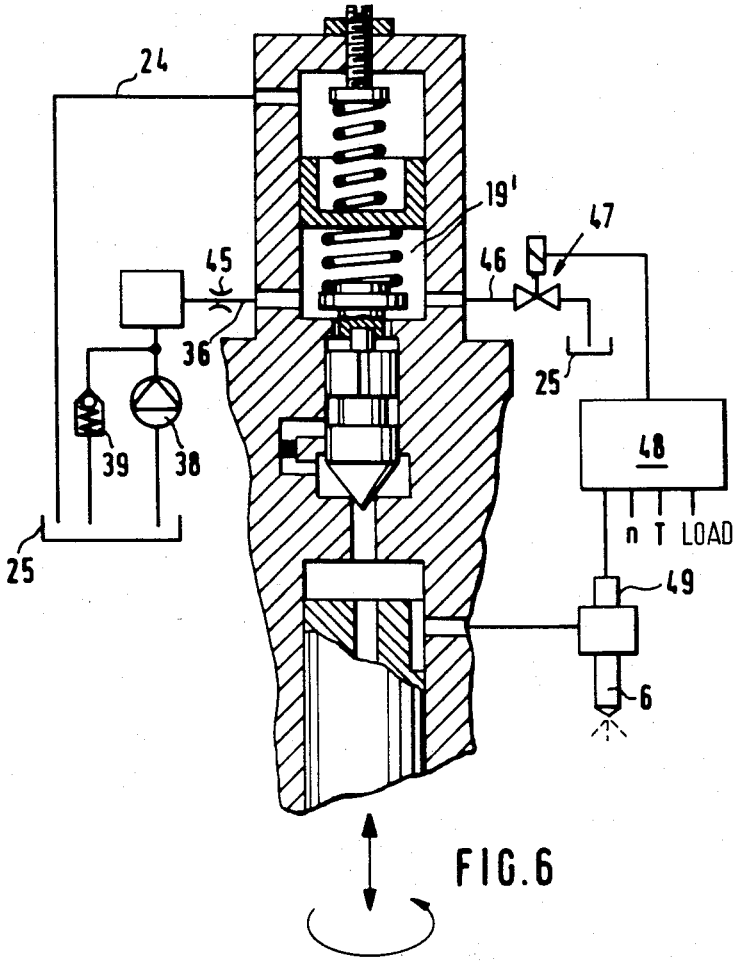
FIG. 6 shows a second exemplary embodiment according to the invention having regulated fluid pressure in the restoring chamber.

An improvement in the adaptation of the pre-injection quantity to given operating conditions of the engine is attained with the embodiment of FIG. 6. This is an apparatus embodied substantially like that of FIG. 1, but in this latter case a throttle 45 which acts as a uncoupling throttle is disposed in the pressure medium supply line 36'. As the source of pressure medium, the fuel feed pump 38 is again available; its pumping pressure can be varied by means of a pressure control valve 39, but for the purposes of the intervention made with this exemplary embodiment its pumping pressure need not be varied. The fuel feed pump 38 does, however, advantageously serve together with the pressure control valve 39 to supply pressure to the pump suction chamber of the fuel injection pump, with the rpm-dependent pressure of which an injection adjuster, for instance (not shown here), is actuated in accordance with rpm.

The restoring chamber 19' is further connected with a relief line 46, in which a magnetic valve 47 is disposed and which leads to the fuel supply container 25. The magnetic valve 47 is controlled by a control device 48. As its essential control signal, this control device 48 receives the output signal of a needle stroke transducer 49 at the injection valve 6, and as its supplementary signals for forming or scanning a set-point value, the control device 48 receives control signals corresponding for instance to rpm, temperature or load. In the control device, an actual value for the pre-injection quantity is formed from the control value corresponding to the valve needle stroke, and this actual value is then compared with a set-point value. In accordance with the deviation of the actual value from the set-point value, a correction signal if formed, in accordance with which the driving of the magnetic valve 47 is varied. The magnetic valve 47 may be actuated in either a clocked or an analog manner, although preference is given to the clocked actuation. In accordance with the correction value, the duty cycle of the control signals for the magnetic valve is varied, and the quantity of fuel flowing out of the restoring chamber 19' is influenced accordingly as well. In this manner, with the use of the uncoupling throttle 45, an arbitrary pressure can be established in the restoring chamber 19'; but this pressure will still vary in accordance with rpm in a first approximation. The set-point value for the pre-injection quantity is formed either in analog fashion, from operating parameters such as rpm, temperature or load which affect the combustion behavior of the fuel in the combustion chamber, or optimal values of this set-point value are stored in a unidimensional or multidimensional performance graph, from whence the control device can call up the set-point value. Such functions can preferably be performed by computers or microprocessors.

Otherwise the functioning of this apparatus is identical to that of the exemplary embodiment of FIG. 1; in other words, the restoring force upon the deflecting piston 14 is modified by means of the pressure in the restoring chamber 19'.

Figure 7:
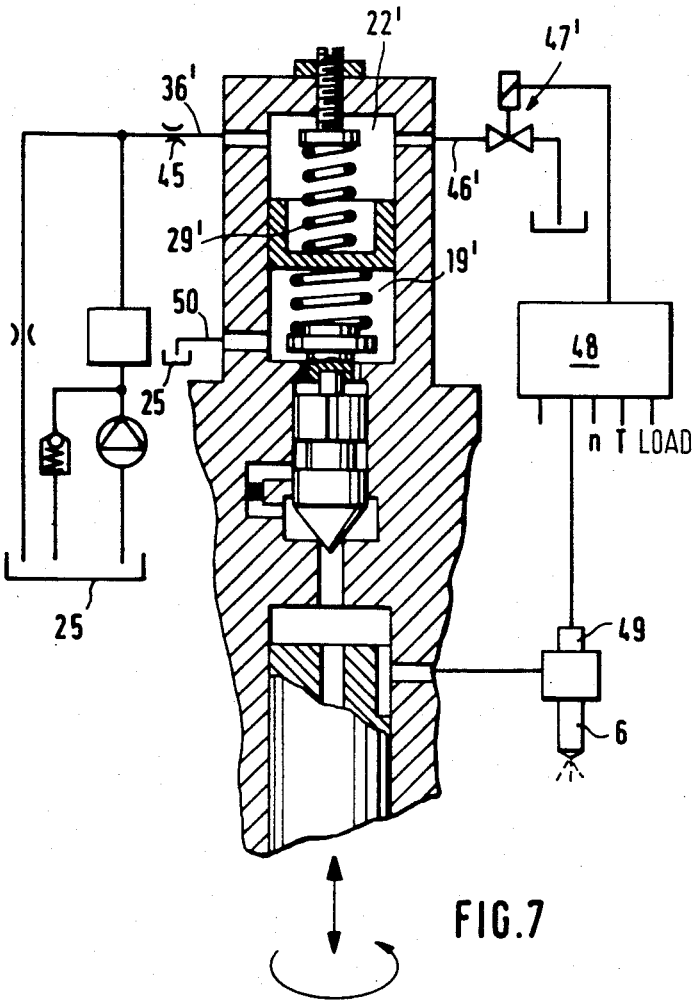
FIG. 7 shows a third exemplary embodiment, as a variant of the embodiment of FIG. 6.

In the third exemplary embodiment, shown in FIG. 7, a modification of the exemplary embodiment of FIG. 6 provides that the pressure chamber 22' is supplied with pressure medium by the pressure medium supply line 36, the pressure chamber 22' again being uncoupled from the pressure source by means of an uncoupling throttle 45. The pressure chamber 22' can be relieved in a controlled manner via the relief line 46', which again contains the magnetic valve 47'. The driving of the magnetic valve 47 is effected in the same manner as in the exemplary embodiment of FIG. 6, except that here the control is complementary to the control in FIG. 6, because in this third embodiment the pressure in the pressure chamber 22' must decrease with increasing rpm. However, it is also possible in this embodiment for the additional spring 29' to be embodied as a tension spring, in which case the pressure in the pressure chamber 22' can increase with increasing rpm. On the other hand, with an appropriate adaptation, an additional spring in the pressure chamber 22 or 22' can even be dispensed with entirely, because the force it exerts on the intermediate piston can be replaced by the pressure in the pressure chamber 22. The restoring chamber 19' in the exemplary embodiment of FIG. 7 is connected via a leakage line 50 with the fuel supply container 25, so that no pressure affecting the pressure regulation in the pressure chamber 22 will be able to build up in the restoring chamber, and so that the leakage fuel quantity arriving from the annular groove 31 can flow out as well.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States:

1. A fuel injection pump comprising at least one pump piston and a pump work chamber defined by said piston, a withdrawal chamber connected with said work chamber in order to influence a course of fuel injection at a fuel injection line supplied by said work chamber, said fuel withdrawal chamber being defined by a first movable wall which on the side remote from said fuel withdrawal chamber is loaded by a restoring means comprising a restoring spring towards an abutment of said first movable wall, said restoring means being provided in a restoring chamber, and simultaneously acting upon a second movable wall defining said restoring chamber, a variable pressure medium, said second movable wall being subjected to a variable pressure of said variable pressure medium, the position of said second movable wall relative to said abutment of said first movable wall is varied over the entire operating range of the fuel injection pump in counterbalance of forces resulting from said restoring sring and said varying pressure of said variable pressure medium and thereby controlling the restoring force of said restoring means acting upon said first movable wall.

2. A fuel injection pump as defined by claim 1, in which the pressure of the pressure medium varies with the rpm of the fuel injection pump.

3. A fuel injection pump as defind by claim 2, in which said second movable wall has a larger effective surface area than the effective surface area of the first movable wall adjoining the restoring chamber, and the second movable wall is disposed between said restoring spring, which engages the first movable wall and an additional spring, and that the restoring chamber between the first movable wall and the second movable wall is filled with a pressure medium the pressure of which increases with the increasing rpm.

4. A fuel injection pump as defined by claim 3, in which the restoring chamber communicates with a source of pressure medium the pressure of which varies in accordance with rpm.

5. A fuel injection pump as defined by claim 3, in which the restoring chamber is relievable via a relief line, in which a valve connected with a control device is disposed, and said restoring chamber is connected via a pressure medium supply line containing a throttle with a source of pressure medium.

6. A fuel injection pump as defined by claim 4, in which the restoring chamber is relievable via a relief line, in which a valve connected with a control device is disposed, and said restoring chamber is connected to said source of pressure medium via a pressure medium supply line containing a throttle.

7. A fuel injection pump as defined by claim 2, in which the second movable wall is stressed by a restoring spring which engages the first movable wall, and that the second movable wall defines a pressure chamber which is connected with a source of pressure via a pressure medium supply line provided with an uncoupling throttle and said pressure chamber is relievable via a relief line, in which a valve is disposed and controlled by means of a control device.

8. A fuel injection pump as defined by claim 5, in which the control device is connected with a needle stroke transducer for measuring the movement of a valve needle of a fuel injection valve supplied by the fuel injection pump and has a device for forming a set-point value in accordance with a desired course of fuel injection at various operating points of the engine as well as a comparison device for comparing an actual value, formed from the valve needle stroke, with the set-point value and for generating a control signal corresponding to the deviation of the actual value from the set-point value for controlling the valve in the relief line.

9. A fuel injection pump as defined by claim 7, in which the control device is connected with a needle stroke transducer for measuring the moement of a valve needle of a fuel injection valve supplied by the fuel injection pump and has a device for forming a set-point value in accordance with a desired course of fuel injection at various operating points of the engine as well as a comparison device for comparing an actual value formed from the valve needle stroke with the set-point value and for generating a control signal corresponding to the deviation of the actual value from the set-point value for controlling the valve in the relief line.

10. A fuel injection pump as defined by claim 8, in which the set-point values are stored in a memory and can be called up in accordance with operating parameters.

11. A fuel injection pump as defined by claim 9, in which the set-point values are stored in a memory and can be called up in accordance with operating parameters.

12. A fuel injection pump as defined by claim 7, in which at least one addition spring is disposed in the pressure chamber, said spring being fastened between the second movable wall and an adjustable stop.

13. A fuel injection pump as defined by claim 1, in which the first movable wall is a deflecting piston tightly guided within a cylinder, which piston, with its one end face defines the withdrawal chamber.

14. A fuel injection pump as defined by claim 13, in which the one end face of the deflecting piston is embodied as conical and cooperates as a valve seat with a mouth in the withdrawal chamber of a line extending from the pump work chamber.

15. A fuel injection pump as defined by claim 14, in which in the initial position of the deflecting piston with the end face resting on the valve seat, the withdrawal chamber surrounding the conical end face is connected in a throttled manner with a relief chamber via a relief line extending at least in part within the deflecting piston, and this connection is closable immediately following the rising of the deflecting piston from the valve seat by means of the relative displacement of the relief line within the deflecting piston.

16. A fuel injection pump as defined by claim 15, in which the relief line in the deflecting piston communicates continuously with the restoring chamber.

17. A fuel injection pump as defined by claim 16, in which the throttling of the connection of the withdrawal chamber with the relief chamber is formed by means of an overlap of the relief line at the deflecting piston with a cross section of a line connection with the withdrawal chamber.

18. A fuel injection pump as defined by claim 17, in which said line connection contains a throttle and leads from the withdrawal chamber into said cylinder containing said deflecting piston and the mouth of the connection line into the cylinder is in communication, when the conical end face is resting on the valve seat, with said relief line in the deflecting piston.

19. A fuel injection pump as defined by claim 15, in which the relief line in the piston at least in part comprises an annular groove.

20. A fuel injection pump as defined claim 1, in that the second movable wall is embodied by an intermediate piston, which is tightly displaceable in a cylinder.

* * * * *